US006982013B1

(12) United States Patent
Fallis et al.

(10) Patent No.: US 6,982,013 B1
(45) Date of Patent: Jan. 3, 2006

(54) ELECTROSTATIC CHARGE DISSIPATION COMPOSITIONS INCLUDING ENERGETIC PARTICLES

(75) Inventors: Stephen Fallis, Ridgecrest, CA (US); Jennifer A. Irvin, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 127 days.

(21) Appl. No.: 10/389,577

(22) Filed: Mar. 17, 2003

(51) Int. Cl.
*C06B 45/10* (2006.01)

(52) U.S. Cl. ..... 149/19.1; 149/19.9; 149/19.92

(58) Field of Classification Search ..... 149/19.1, 149/19.9, 36, 109.6, 19.92
See application file for complete search history.

(56) References Cited

U.S. PATENT DOCUMENTS 3,765,334 A 10/1973 Rentz et al.
4,072,546 A 2/1978 Winer
4,695,705 A 9/1987 Kulig
5,547,525 A * 8/1996 Bennett et al. ..... 149/19.1
6,458,227 B1 * 10/2002 Hiskey et al. ..... 149/19.1
6,512,354 B2 * 1/2003 Jacobson et al. ..... 324/71.1
6,521,063 B1 * 2/2003 Warren et al. ..... 149/19.4

OTHER PUBLICATIONS

G.E. Jabbour, et al., Appl. Phys. Lett. 1997, v. 71 (13), p. 1762 Jennifer A. Irvin, et al., Conducting polymers as Static Dissipating Binders for Energetic Materials, American Chemical Society, Mar. 11, 2002.

* cited by examiner

*Primary Examiner*—Aileen Felton
(74) *Attorney, Agent, or Firm*—Charlene A. Haley

(57) ABSTRACT

An electrostatic charge dissipation composition having at least one energetic particle component and at least one electrically active polymer is coated on the energetic component and thereafter, the polymer coating is oxidized. In another embodiment, the electrostatic charge dissipation composition includes at least one energetic particle component, at least one non-conducting polymer binder, and at least one electrically active polymer is coated on the energetic component/binder mixture and thereafter, the polymer coating is oxidized.

17 Claims, 2 Drawing Sheets

ELECTROSTATIC CHARGE DISSIPATION COMPOSITIONS INCLUDING ENERGETIC PARTICLES

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

This invention relates to electrostatic charge dissipation reduction systems for compositions having energetic particles, and more specifically, the use of conducting polymers as static dissipating binders for energetic particles to prevent premature ignition of the energetic particles which are found in commercial products including solid propellants, explosives, fire suppressing gas generators, and pyrotechnic compositions.

BACKGROUND OF THE INVENTION

The sensitivity to electrostatic discharge of compositions having energetic particles, including solid propellant, gas generating, and pyrotechnic compositions, is well known. Numerous sources of electrical discharge have been cited as possible causes of catastrophic explosions or premature ignition of rocket motors containing solid propellants. External sources include natural lightning, electromagnetic pulses, high power microwave energy, and the like. In addition, static electricity charges are normally present at the interfaces between the various phases in the propellant, insulation, liner, and other parts of the rocket motor. Charging of surfaces may occur by surface-to-surface contact (triboelectric contact) and by the cracking or separation of the solid phase, as in fractoelectrification.

Sudden discharge of this electrostatic energy may result in an explosion of materials or generate sufficient heat to ignite the solid propellant. Such catastrophic events have the potential for causing harm to people and property.

One manufacturing operation which has been implicated as a cause of catastrophic discharge and premature propellant ignition is the core pulling operation, i.e., removal of the core molds from the solid propellant grain after the grain is cast. Other manufacturing operations have the potential for causing rapid electrostatic discharge. Such events may also occur during storage, transportation, and deployment of materials or rocket motors.

The safety properties of any energetic material, whether it is a neat component or an energetic formulation such as a propellant or PBX (Plastic Bonded Explosive), are of primary concern when handling such materials. Friction, impact, and electrostatic sensitivity are measured for each energetic material and compared to standards, typically pentaerythritol tetranitrate (PETN) or cyclotrimethylenetrinitramine (RDX). The military has determined a pass/fail value for each test; should a material fail any of these tests, limitations on its handling are imposed. The test to determine electrostatic sensitivity involves discharging a stored charge through a needle to a metal crucible containing the energetic material and monitoring for adverse reactions (fire, explosion, etc.) The pass/fail value for this test is 5000 volts (0.25 joules) and mimics the maximum charge a human can discharge after static build up. Coating energetics with conducting polymers or using a conductive polymer as part of a binder system could dramatically reduce electrostatic sensitivity.

Composite solid propellants have a very complex microstructure consisting of a dense pack of particles embedded in a polymeric binder matrix. The particles typically comprise fuel, oxidizers, combustion control agents, and the like. The particles may have a wide variety of sizes, shapes, and electrical properties. Electrostatic charges typically build up on the binder-filler interfaces, on the grain surface, as well as at the interfaces between other components of the propellant, e.g. at the interface between conductive particles such as aluminum powder and a nonconductive or less-conductive binder.

Certain propellant compositions have a greater conductivity than other compositions. For example, a propellant having a polar polymer may contain dissociated ionic species available for charge transport and would have relatively high conductivity. Such ionic species may be present from ammonium perchlorate dissolved in the polar binder. Electrostatic charges are readily dissipated and catastrophic discharge is unlikely with this type of propellant binder system.

One approach to reduce the electrostatic sensitivity of a particular formulation is to blend in a small amount of graphite (~1%). However, this is often not successful, and addition of such materials detracts from the performance as energetic components are sacrificed to include them. For example, BTATZ, which has acceptable friction and impact sensitivity, does not pass the electrostatic sensitivity test (fires at 0.15 joules) as a neat component or when blended with poly(ethyl acrylate) as a binder. Addition of graphite to the poly(ethyl acrylate)/BTATZ formulation shows no noticeable improvement. Another approach involves using containers coated with fatty amines, but this only contributes to safe storage of materials and to prevent static adherence to the container. Other approaches involve slurrying the energetic components with binder components, such as poly lauryl methacrylate and hydroxy-terminated polybutadiene, to produce a coated explosive material (CXM), a free flowing powder free of static attraction, with decreased sensitivity to electrostatic initiation.

U.S. Pat. No. 3,765,334 issued Oct. 16, 1973 to Rentz et al. reports adding graphite to igniter compositions to prevent electrostatic charge build up. It is reported that at least 16 percent graphite is required to achieve adequate conductivity. Such amounts of graphite adversely affect performance of energetic materials. U.S. Pat. No. 4,072,546 issued Feb. 7, 1978 to Winer and U.S. Pat. No. 4,696,705 issued Sep. 29, 1987 to Hamilton, teaches graphite fibers in solid propellant and gas generating compositions to provide structural reinforcement and burn rate control. However, it is known that even small amounts of graphite fibers markedly increase the processing viscosity of propellant compositions. Even slight increases in viscosity can detrimentally affect processing and propellant rheology.

In another propellant, the solid constituents are bound in a polybutadiene/acrylonitrile/acrylic acid terpolymer binder (PBAN). The binder polymer contains polar nitrile functional groups along its backbone. In this system, a quaternary benzyl alkyl ammonium chloride is added to the binder polymer during manufacturing. The polymer and the quaternary ammonium salt together provide a relatively high electrical conductivity.

Another commonly used binder system in solid rocket propellant compositions is hydroxy-terminated polybutadiene (HTPB). In contrast to the poly(ethylene glycol) (PEG)

and PBAN binder systems, HTPB binders are nonpolar and have an intrinsic high insulation value. Thus, HTPB-based propellants are more susceptible, under certain circumstances, to high charge build-up with the potential for catastrophic electrostatic discharge.

Some pyrotechnic compositions are comprised of solid particles embedded in polymers and are susceptible to electrostatic discharge, as are solid propellants. Some pyrotechnic compositions are prepared without binders. The ingredients are either mixed dry or in an evaporative solvent. Dry mixing of pyrotechnic ingredients is particularly susceptible to electrostatic discharge. It is generally known that as air flows across a surface, charge buildup occurs. In dry mixing, there is a very large surface area, creating the potential for charge buildup and electrostatic discharge.

Low loading levels of conducting polymers (1–5% of the total weight) have been shown to effectively dissipate charge in coatings and textiles, leading to anti-static applications in microelectronics, fabrics, and carpeting. Fabrics coated with conducting polymers exhibit conductivities orders of magnitude higher than those seen in carbon-filled fabrics, likely due to improved continuity of the conducting portion of the fabric. Nanocomposites are formed by deposition of conducting polymers onto a wide variety of particle types, leading to bulk conductivities one to two orders of magnitude less than the corresponding pristine conducting polymer.

From the foregoing, it will be appreciated that there is a need in the art for electrostatic charge dissipation compositions, which have sufficient conductivity to reduce electrostatic discharge susceptibility, yet which are processible, retain energetic performance, and retain comparable ballistic, mechanical, and rheological properties. It would also be an advancement in the art to provide methods for reducing electrostatic discharge in compositions having energetic particles.

SUMMARY OF THE INVENTION

The present invention relates to electrostatic reduction systems for compositions having energetic particles. One preferred embodiment of the present invention includes an electrostatic charge dissipation composition having at least one energetic particle component and at least one electrically active polymer is coated on the energetic component and thereafter, the polymer coating is oxidized. In another embodiment of the present invention the electrostatic charge dissipation composition includes at least one energetic particle component, at least one non-conducting polymer binder, and at least one electrically active polymer is coated on the energetic component/binder mixture and thereafter, the polymer coating is oxidized. The polymer is deposited on the energetic particle component to provide sufficient conductivity to prevent premature electrostatic discharge of the composition.

The most preferred binder is selected from the group consisting of poly(lauryl methacrylate) (PLMA), hydroxyl-terminated polybutadiene (HTPB), poly(ethyl acrylate), and any combination thereof. Other preferred non-conducting binders are selected from the group consisting of nitrocellulose, glycidyl azide polymer (GAP), poly glycidyl nitrate (PGN), cellulose acetate, organic-elastomers (poly(ethyl acrylate)), halogenated elastomers (polyvinyl chloride, Kel-F, and Viton), and any combination thereof. The conducting polymer is sufficiently deposited to form a continuous interconnecting network having multiple sets of contact points so that there are sufficient infinite paths that promote static dissipating properties.

The energetic particle component is selected from the group consisting of lead azide, lead styphnate, mercury fulminate, silver azide, diazodinitrophenol, tetrazene, hexanitro-hexa-aza-isowurtzitane, ammonium perchlorate, ammonium ditramide, ammonium nitrate, cyclotrimethylenetrinitramine, cyclotetramethylene tetranitramine, bis (aminotetrazolyl) tetrazine (BTATZ), their analogs, homologs, derivatives, salts, and any combination thereof. The most preferred conducting polymer is selected from the group consisting of polythiophene (PT), poly(3,4-ethylenedioxythiophene) (PEDOT), polypyrrole (PPy), their analogs, homologs, derivatives, isomers, and any combination thereof. Other conducting polymers are further selected from the group consisting of polyaniline (PANI), polyacetylene (PA), their analogs, homologs, derivatives, isomers, and any combination thereof.

Electrically active polymers are selected from the group consisting of polythiophene is (PT), poly(3,4-ethylenedioxythiophene) (PEDOT), polypyrrole (PPy), polyaniline (PANI), polyacetylene (PA), modified to contain solublizing substituents including (alkyls, ethers, aromatics, oligomeric ethers), and or substituents for improved binder function of crosslinking groups including (acrylates, methacrylates, urethanes, and epoxides), or the conducting polymers could be in combination with crosslinkers such as carboxy terminated butadiene (CTPB) or poly(alkylene oxide) (PAO). Preferred non-conducting energetic binders of the present invention include, but not limited to, nitrocellulose, glycidyl azide polymer (GAP), polyglycidyl nitrate (PGN), and cellulose acetate.

The electrostatic charge dissipation composition includes, but is not limited to, energetic compositions, propellant compositions, and gas generant compositions. The most preferred electrostatic charge dissipation composition includes energetic particle component(s) of about 90% to about 95% by weight and the conducting polymer is about 5% to about 10% by weight of the composition.

It is an object of the present invention to provide an electrostatic charge dissipation composition including conducting polymers for decreasing electrostatic sensitivity of energetic materials.

It is another object of the present invention to coat the energetic particles with at least one conducting polymer to provide electrostatic dissipation to prevent premature discharge of energetic materials.

It is a further object of the present invention to coat an energetic/binder particle with at least one conducting polymer to increase the conductivity of the coated particle, which provides electrostatic dissipation.

Still another object of the present invention is to prepare a coating of conducting polymer(s) to the energetic particles that provides a continuous interconnecting network of contact points upon compression molding to effectively dissipate static charge.

Still yet another object of a preferred embodiment of the present invention is to coat an energetic particle with a conducting polymer that will serve as the binder and static dissipating agent to both decrease electrostatic sensitivity of the energetic materials and simplify the formulation by decreasing the total amount of additive.

Yet still another further object of a preferred embodiment of the present invention is to coat with neutral, soluble electroactive polymers such as poly(3-hexylthiophene) to provide a more uniform coating of the energetic particles.

Oxidation of the polymer coating then yields a conductive coating which reduces electrostatic discharge susceptibility.

It is to be understood that the foregoing general description and the following detailed description are exemplary and explanatory only and are not to be viewed as being restrictive of the present invention, as claimed. These and other objects, features and advantages of the present invention will become apparent after a review of the following detailed description of the disclosed embodiments and the appended claims.

DESCRIPTION OF THE PREFERRED EMBODIMENTS

Figure 1:
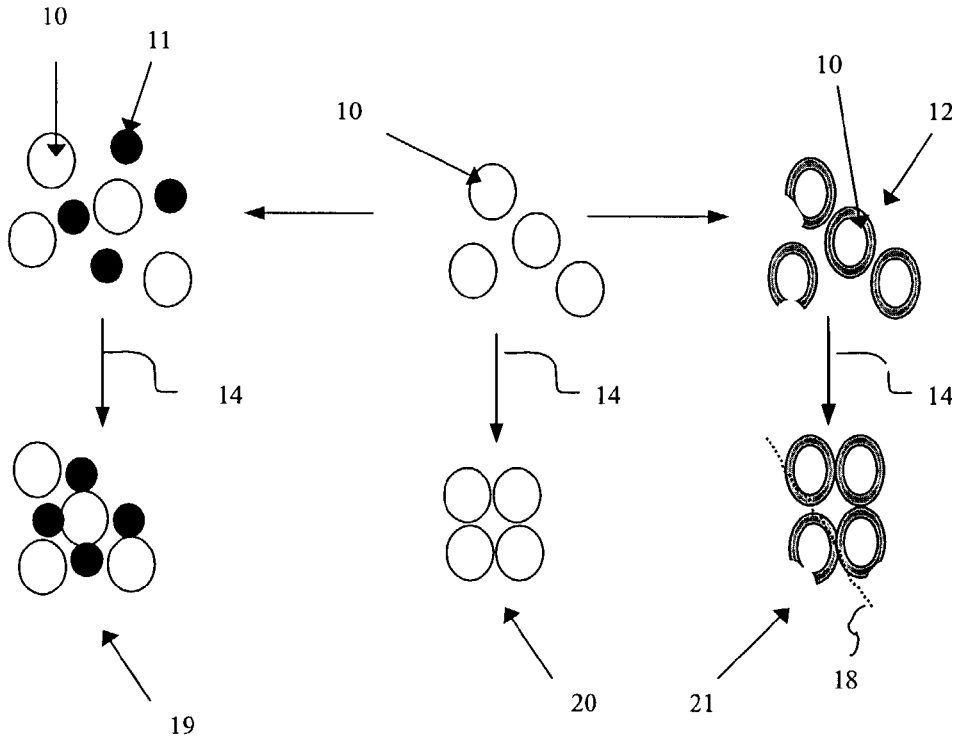
FIG. 1 is an illustration representing a preferred embodiment of the present invention showing the treatment of energetic particles when a non-conducting polymer binder is not utilized in the electrostatic charge dissipation composition according to the present invention.
Figure 2:
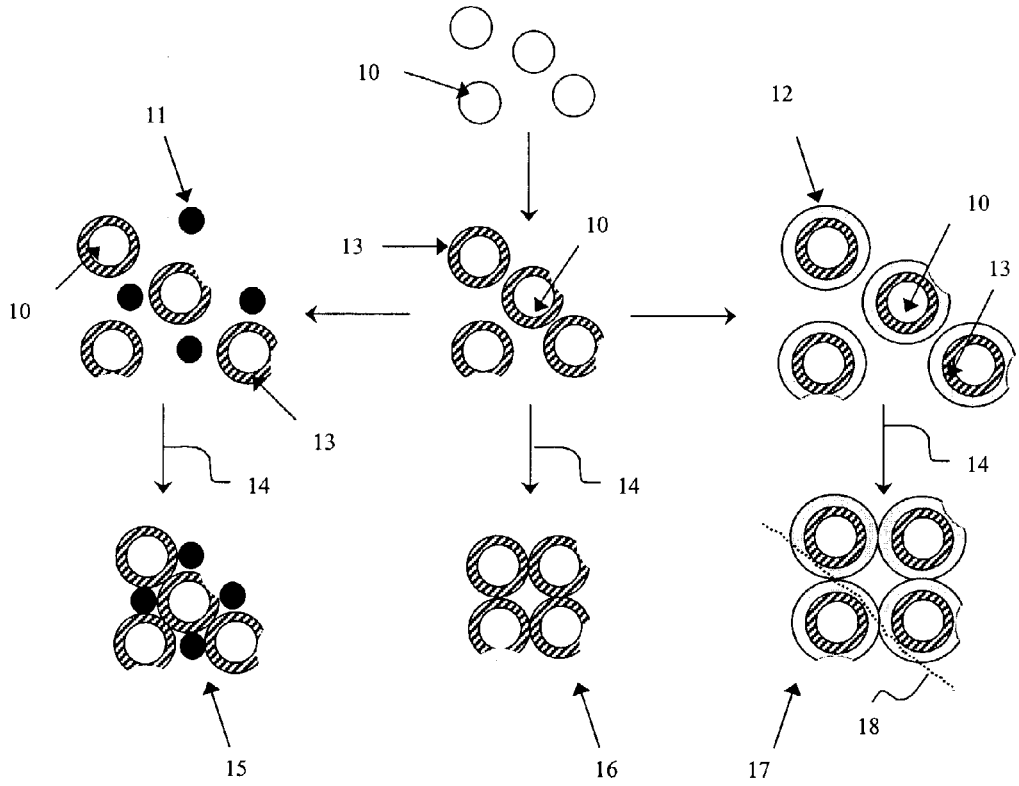
FIG. 2 is an illustration representing another preferred embodiment of the present invention showing the treatment of energetic particles when a non-conducting polymer binder is utilized in the electrostatic charge dissipation composition according to the present invention.

The present invention is a novel electrostatic charge dissipation composition including energetic particles to prevent premature electrostatic discharge and to provide a continuous interconnecting network of contact points to effectively dissipate static charge. FIGS. 1 and 2 illustrate the most preferred embodiments of the electrostatic charge dissipation composition. The electrostatic charge dissipation compositions of the present invention include, but are not limited to, energetic compositions, propellant compositions, and gas generant compositions.

One preferred embodiment of the first aspect of the present invention includes an electrostatic charge dissipation composition having at least one energetic particle component and at least one oxidized conducting polymer deposited on the energetic component. In another preferred embodiment, the electrostatic charge dissipation composition includes at least one energetic particle component, at least one non-conducting polymer binder, and at least one oxidized conducting polymer deposited on the energetic/binder composition.

In another embodiment, the electrostatic charge dissipation composition includes at least one energetic particle component and at least one electrically active polymer is coated on the energetic component and thereafter, the polymer coating is oxidized. In still another embodiment of the present invention the electrostatic charge dissipation composition includes at least one energetic particle component, at least one non-conducting polymer binder, and at least one electrically active polymer is coated on the energetic component/binder mixture and thereafter, the polymer coating is oxidized. The conducting polymer is deposited on the energetic particle component to provide sufficient conductivity to prevent premature electrostatic discharge of the composition.

A preferred electrostatic charge dissipation composition includes energetic particle component(s) of about 80% to about 99.9% by weight and conducting polymer is about 0.1% to about 20% by weight of the composition. The most preferred electrostatic charge dissipation composition includes energetic particle component(s) of about 90% to about 95% by weight and the conducting polymer is about 5% to about 10% by weight of the composition. The present invention is directed to the use of conducting polymers in electrostatic charge dissipation compositions for reducing electrostatic discharge susceptibility. The conducting polymer is sufficiently deposited to form a continuous interconnecting network having multiple sets of contact points so that there are sufficient infinite paths that promote static dissipating properties.

In a most preferred embodiment of the present invention the propellant composition comprises at least one energetic particle component including BTATZ, wherein the energetic component is about 90 to about 95% by weight of the propellant composition and at least one conducting polymer in its oxidized form including PEDOT and/or PT, wherein the conducting polymer is about 5 to about 10% by weight of the propellant composition which is deposited onto the energetic particle component to provide sufficient conductivity to prevent premature electrostatic discharge of the propellant composition.

The most preferred conducting polymers used in the present invention are polythiophene (PT), poly(3,4-ethylenedioxythiophene) (PEDOT), polypyrrole (PPy), polyaniline, polyacetylene and modifications of all the polymers to include solublizing substituents (alkyls, ethers, aromatics, oligomeric ethers) as well as other substituents for improved binder function, such as crosslinking groups (acrylates, methacrylates, urethanes, and epoxides), or the conducting polymers could be in combination with crosslinkers such as carboxy terminated butadiene (CTPB) or poly(alkylene oxide) (PAO). Preferred non-conducting energetic binders of the present invention include, but not limited to, nitrocellulose, glycidyl azide polymer (GAP), polyglycidyl nitrate (PGN), and cellulose acetate.

In a preferred embodiment of the second aspect of the present invention is the method of reducing electrostatic discharge susceptibility in the above electrostatic charge dissipation compositions including: providing an energetic particle component for discharge, providing at least one electrically active polymer; depositing the polymer(s) onto the energetic particle component to prevent premature electrostatic discharge of the composition; and oxidizing the polymer(s) with an oxidizing agent to provide sufficient conductivity to reduce electrostatic discharge of the composition. In another embodiment, the active polymer is first oxidized resulting in deposition onto the energetic particle component. Another preferred embodiment further includes at least one non-conducting polymer binder mixed with the energetic particle component before coating of either an electrically active polymer or a conducting polymer.

In FIG. 1, white circles represent loose energetic particles 10. Compression-molding 14 of these energetic particles 10 (the middle downward arrow) does not provide any static dissipation 20. Graphite particles 11 (represented as black circles) are combined with the energetic particles 10 (left arrow) and then compression molded 14 (leftmost downward arrow), providing some degree of static dissipation 19. However, the graphite particles 11 do not provide a continuous conductive pathway, and the level of static dissipation is not adequate for the present invention (BTATZ in the composition). In a preferred embodiment, an electroactive polymer 12 (represented by the gray layer surrounding the energetic particles 10) is deposited on the surface of the energetic particles 10 (right arrow). This deposition is preferably accomplished by oxidative polymerization of the appropriate monomers in the presence of a suspension of energetic particles 10, causing the doped, conducting polymer 12 to deposit on the surface of the particles 10, or it is preferably accomplished by coating of a solution of the neutral polymer 12 on the surface of the particles 10, with doping of the electroactive polymer 12 (to make it conductive) occurring either during or after the deposition process. The conducting polymer-coated particles 10 and 12 are preferably compression molded (rightmost downward facing arrow) to form a continuous conductive pathway over the surface of the energetic particles 10 (as represented by the dashed line 18). The coatings may or may not be perfect as indicated by the small defects shown in FIGS. 1 and 2, and a perfect coating is not necessary to provide adequate conductivity.

In FIG. 2, loose energetic particles 10 (represented as white circles) are coated with a binder 13 (represented by the striped layer surrounding the energetic particles 10) and the coating process preferably accomplished by using a solution deposition method (described below). Compression-molding 14 of these binder-coated energetic particles 10 and 13 (the middle downward arrow) does not provide any static dissipation 16. Graphite particles 11 (represented as black circles) are combined with the binder-coated energetic particles 10 and 13 (left arrow) and are compression molded (leftmost downward arrow) providing some degree of static dissipation 15. However, the graphite particles 11 do not provide a continuous conductive pathway, and the level of static dissipation is not adequate (BTATZ in the composition) for the present invention. In a preferred embodiment of the electrostatic charge dissipation composition, an electroactive polymer 12 (represented by the gray layer surrounding the binder-coated energetic particles 10 and 13) is deposited on the surface of the binder-coated energetic particles 10 and 13 (right arrow). This deposition is preferably accomplished by oxidative polymerization of the appropriate monomers in the presence of a suspension of binder-coated energetic particles 10 and 13, causing the doped, conducting polymer 12 to deposit on the surface of the particles 10 and 13, or it is preferably accomplished by coating of a solution of the neutral polymer 12 on the surface of the particles 10 and 13, with doping of the electroactive polymer 12 (to make it conductive) occurring either during or after the deposition process. The conducting polymer-coated binder-coated particles 10, 12, and 13 are preferably compression molded (rightmost downward facing arrow) to form a continuous conductive pathway over the surface of the energetic particles 10 and 13 (as represented by the dashed line 18).

Coating of energetic/binder particles in one embodiment (not when utilizing neutral polymers) is accomplished by the precipitation of the polymer from solution onto the surface of the suspended particles. The energetic particles and/or energetic/binder particles are coated in this way, to varying degrees (from about 0.1 weight % to about 15 weight % of conducting polymer(s)). The conducting polymer(s) in a most preferred embodiment is about 5–10% by weight of composition. The thickness of the conducting polymer coated on the energetic particle is variable depending on many factors in the coating process and energetic particle size and positions. The conducting polymer(s) is deposited on energetic particles and energetic/binder particles in various thicknesses necessary to provide a coating. The coating is preferably deposited in a way that when compression molding is applied, the coating layers provide sufficient continuous network of interconnecting contact points throughout the composition to effectively dissipate static charge.

Examples of energetics that benefit from this procedure are lead azide, lead styphnate, mercury fulminate, silver azide, diazodinitrophenol, tetrazene, hexa-nitro-hexa-aza-isowurtzitane (CL-20), ammonium ditramide (ADN), ammonium perchlorate (AP), ammonium nitrate (AN), cyclotrimethylenetrinitramine (RDX) and cyclotetramethylene tetranitramine (HMX), bis (aminotetrazolyl) tetrazine (BTATZ), their salts, analogs, homologs, and derivatives thereof. However, any energetic particle may be used with the present invention. Particle size and size distribution vary widely by the type of energetic used. The energetic particles may range in size within the electrostatic charge dissipation composition or all particles are selected of a particular uniform size. For example, BTATZ has a large distribution of particle sizes, while other energetic particles may be monodisperse. The energetic particles used in the present invention preferably range in size from about 1 $\mu$m to about 500 $\mu$m. Some of the most preferred energetic components are illustrated below.

BT ATZ

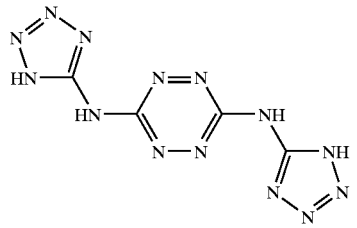

CL-20

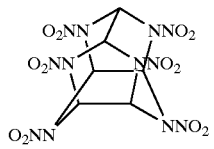

RDX

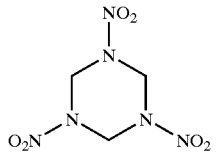

HMX

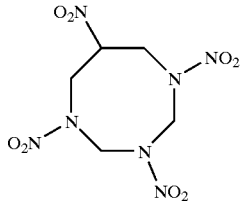

P ETN

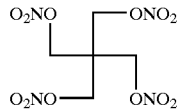

The conducting polymer is in an effective quantity of oxidatively doped polymer to provide a conductivity of at least approximately $10^{-5}$ S/cm to greater than approximately $10^{5}$ S/cm. However, unexpectedly, when the conducting polymer is PT and conductivity is less than $<10^{-7}$ S/cm, the composition most effectively dissipated the charge. The most preferred dopant for the polymerization process in the present invention is ferric salts, preferably, the oxidizing agent including ferric chloride. Other ferric salts known in the art are adapted to be utilized with the present invention are, but not limited to, perchlorate, bromide, hexafluorophosphate, and tetrafluoroborate, etc. In other embodiments of the present invention, ammonium perchlorate (in solution) or other perchlorates (tetrabutylammonium, tetraethylammonium, etc.) are adapted to be utilized when neutral polymers are selected. Other preferred dopants for the polymerization process in the present invention include halogens, cupric salts, Lewis acids, cupric salt/Lewis acids, and gold (III). However, when a coating of a neutral polymer is utilized the use of iodine vapors rather than any solution doping process is most preferred.

Analogs, homologs, derivatives, salts, and isomers of energetic materials and polymers can additionally be utilized with the present invention. The term "analog" refers to a chemical compound with a structural similar to that of another but differing from it in respect to a certain component. The term "homolog" refers one of a series of compounds, each of which is formed from the one before it by the addition of a constant element or a constant group of elements—structural similarity due to descent from a common form. The term "isomer" refers to compounds having the same radicals in physically different positions on the same nucleus. The term "derivative" is a chemical substance derived from another substance either directly or by modification or partial substitution.

Conducting polymers comprise a rapidly growing area of interest for applications including electrochromics, electroluminescence, charge storage, corrosion control, electromagnetic shielding, conductive textiles, and antistatic coatings. Simple non-functionalized conducting polymers tend to be insoluble. This is overcome by the introduction of long or branched alkyl side chains or other solublizing substituents below. Functional groups (methacrylates, OH, SH, etc.) are introduced to these side chains to allow crosslinking if the polymer is part of a cured binder system. The conducting polymers could be in combination with crosslinkers such as carboxy terminated butadiene (CTPB) or poly(alkylene oxide) (PAO). Most preferred curing systems used with the present invention utilize isocyanates such as IPDI, HMDI, and TDI; however, other curing systems known in the art can also be utilized.

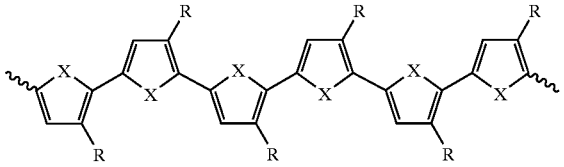

The above polymer is for illustrative purposes only and to show examples of preferred embodiments of a general polyheterocycle structure wherein: X=S, R=H (polythiophene); X=NH, R=H (polypyrrole); and X=S, R=$C_6H_{13}$ (poly(3-hexyl)thiophene).

While minimum conductivities of $10^{-3}$ to $10^{-5}$ S/cm are usually needed for static dissipation, conductivities of $10^1$ to $10^4$ S/cm are typical for pristine conducting polymers in the oxidized state. Nanocomposites are formed by deposition of conducting polymers onto a wide variety of particle types, leading to bulk conductivities one to two orders of magnitude lower than the corresponding pristine conducting polymers, i.e. $10^{-1}$ to $10^3$ S/cm. Thus, conductivities of conducting polymer nanocomposites fall well within the range needed for charge dissipation. Stability of conducting polymers has been extensively studied, and careful choice of polymer and dopant should allow for good long-term antistatic performance even at elevated temperatures. Conducting polymer incorporation into energetic/binder particles provides superior antistatic resistance relative to graphite incorporation.

A conductive coating that includes a network of interconnecting continuous contact points (shown in FIGS. 1 and 2 by dotted lines 18) throughout the energetic mixture is better able to dissipate charge than isolated conductive particles 15, 16, 19, and 20. The most preferred method used for compression molding is described below; however, any suitable method of compression molding can be adapted to be utilized with the present invention. In compression molding, the binder (e.g. poly(ethyl acrylate)) is dissolved in a suitable solvent (e.g. methylene chloride, acetone). The other components of the electrostatic charge dissipation composition are suspended in much larger volume of a solvent in which the binder is poorly soluble or insoluble (e.g. hexane). The solution of the binder is added to the suspension causing the binder to precipitate on the surface of the suspended particles. The binder-coated solids (molding powder) are collected by filtration. Alternatively, if the energetic components are insoluble in the solvent in which the binder is dissolved then they may be suspended in the binder solution and the solvent removed by evaporation giving a molding powder. The molding powder is loaded into a die and pressed to a specified pressure giving pellets of the electrostatic charge dissipation composition. Large numbers of pellets are produced using an automatic press.

Incorporation of graphite particles 11 with energetic/binder particles 10 and 13 provides some charge dissipation 15 upon compression molding. However, some portions of the surface area of the energetic/binder particles 10 and 13 do not contact the graphite, resulting in charge build up. In addition the graphite particles 11 tend to be non-uniformly distributed throughout the material after compression molding and do not provide a continuous network of contact points to effectively dissipate static charge. The conducting polymer coating 12 provides more coverage of the surface area of the energetic particle 10 and/or energetic/binder particles 10 and 13. As a result, conductivity is increased and charge build up is reduced, which results in electrostatic charge dissipation 17 and 21.

EXAMPLE

Polypyrrole (PPy), polythiophene (PT), and poly(3,4-ethylenedioxythiophene) (PEDOT) were deposited onto bis (aminotetrazolyl)tetrazine (BTATZ) via chemical polymerization of the respective monomers with ferric chloride in the presence of BTATZ suspensions. BTATZ is of particular interest as it exhibits a somewhat high sensitivity to electrostatic stimuli. For example, the particle sizes of BTATZ used in this particular example was about 1–500 $\mu$m; however, any size of preferred energetic particles is adapted to be utilized with the present invention.

Gas generator molding powders incorporate an elastomeric binder that allows pressing of the material into pellets. The resulting mixtures were 5–10 weight % conducting polymer, 90–95 weight % BTATZ, with the conducting polymers serving as both binder and static dissipating agent. Scanning electron microscopy was used to evaluate homogeneity of conducting polymer coatings; PEDOT and PT appeared to deposit uniformly over the particles, while PPy did not deposit on the BTATZ particles. Conductivities of the pressed pellets (using PEDOT only) ($10^{-4}$ to $10^{-5}$ S/cm)

were much higher than those of blends of BTATZ with graphite or pre-formed PEDOT ($<10^{-7}$ S/cm), which was higher than that of pristine BTATZ ($10^{-8}$ S/cm). All the conducting polymer-BTATZ blends were less sensitive to static than neat BTATZ or traditional graphite-binder-BTATZ blends; the PT/BTATZ blend is the first formulation of BTATZ to pass the Navy's Electrostatic Sensitivity Test.

Reagents. BTATZ was synthesized from commercially available starting materials. The BTATZ synthesis procedure is described in U.S. Pat. No. 6,458,227 of Hiskey, et al. EDOT was obtained from a supplier, ALDRICH®, and purified as described in Irvin, J. A. et al. *Journal of Polymer Science Polym. Chem. Ed.* Vol. 39, p. 216, 2001, incorporated herein by reference. All other reagents were purchased from ALDRICH® and used as received.

Polymerization. BTATZ (200 mg) was suspended in a solution of monomer (10–20 mg of pyrrole, 3,4-ethylenedioxythiophene, or 2,2'-bithiophene) in $CHCl_3$ or MeOH (6.5 mL). A solution of $FeCl_3$ (2.5 moles per mole of monomer) in the appropriate solvent (1.5–3 mL) was added dropwise, and the suspensions were allowed to stir for 18 hours at room temperature. The amount of $FeCl_3$ can vary from about 1 to 4 moles per mole of monomer, however, 2 to 2.5 moles yielded the best results. Solids were collected by filtration and washed with copious amounts of methanol, water, and again with methanol, then the solids were dried under vacuum. The same conditions were used in the absence of BTATZ to produce pristine oxidized poly(3,4-ethylenedioxythiophene) (PEDOT).

Blending. Dried, doped pristine PEDOT and graphite (10–20 mg) were each co-suspended with BTATZ (200 mg) in $CHCl_3$ (6.5 mL), stirred for 18 hours, filtered, and dried under vacuum to yield discrete conductive particles blended with BTATZ.

Scanning Electron Microscopy (SEM). Uncoated powders were mounted on adhesive stubs and examined using a scanning electron microscope using a lanthanum hexaboride filament operating at 20 kV. An Electro Scan E3 scanning electron microscope was utilized, however, other techniques known in the art can also be used with the present invention. A detector was used in the high vacuum mode. An Eberhart Thornly detector is preferred. ORION® digital capture images were taken from 50× to 5000×. ADOBE® PHOTOSHOP® was used to improve image quality, change image size and convert the image to other formats.

Conductivity Measurements. Pellets of the BTATZ mixtures were prepared by compressing 50 mg samples to 50,000 psi in a 1.33 $cm^2$ die. Conductivity was determined using four-point probe resistivity measurements. The equipment used in the four-point-probe-resistivity measurement consists of a probe assembly and probe head from Signatone, a programmable current source Model 220 from Keithley and a programmable electrometer Model 617 from Keithley. The four points in the probe head have tips composed of a 50% osmium alloy. The points are arranged in a line and are spaced 1-mm apart. The points are mounted in a spring-loaded mechanism inside the probe head. The spring loading helps to prevent the tips from getting damaged when the probe head is lowered onto the surface of the sample. The spring tension provides a contact force of 45 grams. The current source has a range of 1 nanoAmp to 0.1 Amp, a maximum voltage limit of 100 V and reversible polarity.

The four-point-probe-resistivity measurement is based on the long-established Van der Pauw method in which the average resistance of a thin layer or sheet is determined by passing current through the outside two points of the probe and measuring the voltage drop across the inside two points. If the spacing between the probe points is constant, and the conducting-film thickness is less than 40% of the spacing, and the edges of the film are more than 4 times the spacing distance from the measurement point, the average resistance of the film or the sheet resistance is given by:

$$R_{sheet}=(\pi/1n2)\ (V/I)=(4.532)\ (V/I)$$

where V is the voltage drop and is the current. The ($\pi$/1n2) term is just a correction factor that is needed for a probe-and-sample geometry or configuration that is consistent with the above description. The resistivity of the film is the sheet resistance divided by the film thickness:

$$\rho=R_{sheet}/t$$

where t is the thickness of the film. Conductivity is $1/\rho$.

Sample thickness was determined using bright field reflectance optical microscopy with a 400× lens. Thickness was measured at three to five locations along the edges of each sample by measuring the vertical travel distance of the microscope stage between the top and bottom focal planes of the sample. The stage displacement at both top and bottom was manually read twice from the microscope focus knob marks with a resolution of 0.5 $\mu$m.

Electrostatic Sensitivity Testing (EST). Samples were placed on a grounded steel button. A capacitor (0.02-microfarad) was charged to 5000V using a high voltage power supply. The positive side of the capacitor was brought into contact with the sample by means of a steel phonograph needle on the end of a probe and discharged through the sample to the steel button, which was grounded to the other side of the capacitor. Samples are considered to be electrostatically sensitive if they ignite at 0.25 joules or lower; to pass the EST, a material must not ignite at 0.25 joules ten out of ten times.

In order to promote uniform coating of BTATZ particles, monomers were oxidatively polymerized in BTATZ suspensions. Three different target polymers, polypyrrole (PPy), polythiophene (PT), and poly(3,4-ethylenedioxythiophene) (PEDOT), all of which are prepared by oxidative polymerization of commercially-available monomers, were chosen for this example. However, many other polymers known in the art are adapted to be utilized with the present invention including, but not limited to, polyaniline, polyacetylene, and modifications of all these polymers to include solublizing substituents (alkyls, ethers, aromatics, oligomeric ethers) as well as other substituents for improved binder function, such as crosslinking groups (acrylates, methacrylates, urethanes). Dioctyl adipate (DOA) is a plasticizer and is added to the binder as further described in U.S. Pat. No. 6,458,227 to Hiskey, et al.

Many of the above polymers may also be utilized in their analog, homolog, derivative, and isomer (preferably regioisomer forms) structures constitutions, or any combinations thereof. Isomers in the present invention mainly focus on regioisomers, and more specifically, include both regioregular and/or regioirregular versions of the same polymer. The term "regioisomer" is a term known to those skilled in the art and is defined in text books such as *Organic Synthesis*, Smith, M., (McGraw Hill) 1994, page 21, which defines a regioisomer as "two or more molecules with the same empirical formula, but with a different attachment of the atoms (different connectivity)". The polymers tested here do not have regioisomers; however, the derivatives of the polymers tested would have regioisomer versions of the same polymer.

There are at least three major reasons to use polymer derivatives. First, to solublize the polymer derivative in cases when the electrically active polymer is coated onto the energetic material and then oxidized. Secondly, polymer derivatives are used to improve compatibility (i.e. modify PPy in that it actually deposits on BTATZ). Finally, polymer derivatives are used to improve binder quality by improving adhesive characteristics.

Standard chemical polymerization conditions were employed, except that the polymerizations occurred in BTATZ suspensions to deposit a conducting polymer (CP) layer on the surface of the BTATZ particles. Monomer concentrations were chosen to yield 5–10 weight percent of CP in the final mixture; CP concentrations must be minimal to maintain adequate energetic properties of the final mixture. The polymers were left in their oxidized state for optimum conductivity and washed to remove oxidant. EDOT was also polymerized in the absence of BTATZ and then blended with BTATZ to yield a mixture of discrete BTATZ and PEDOT particles for comparison to BTATZ/graphite mixtures.

SEM was used to determine the uniformity of the CP coatings. Non-conducting analytes are typically coated with a thin layer of conducting material (Au, Pt, etc.) to prevent charging (visible as bright, blurry spots and/or streaks) and destruction of the analyte when it is exposed to the high voltage beam used in SEM. Conductive substrates, however, such as conducting polymers, require no additional conductive coating to prevent charging. We examined our CP/BTATZ mixtures by SEM. As expected, charging was visible during examination of non-coated pristine BTATZ powder. Interestingly, while PPy(10%)/BTATZ(90%) also exhibited significant charging (a mixture of charged and non-charged particles is evident), no charging occurred in PEDOT(5%)/BTATZ(95%). This suggests that PEDOT deposits with some degree of uniformity on the surface of the BTATZ particles, while PPy precipitates without coating the particles. Derivatization of PPy should improve coating-compatibilities. A mixture of charged and non-charged particles was also visible in the case of the pre-formed PEDOT (5%)/BTATZ(95%) blend. The PT(5%)/BTATZ(95%) mixture did not initially charge in the SEM, indicative of a uniform CP coating; however, non-charged particles slowly began to charge in the SEM beam, eventually yielding a completely charged surface.

For further evidence of charge dissipation, pellets of each mixture were prepared, and their conductivities were determined using electrochemical impedance spectroscopy (EIS); results are summarized in Table 1. A preferred embodiment of the present invention, PEDOT(5%)/BTATZ(95%), was found to be more than 100 times more conductive than graphite(5%)/BTATZ(95%), suggesting that PEDOT better dissipates electrostatic charge than graphite. If conductivity requirements for static dissipation of energetics are the same as those of coated fibers ($10^{-3}$ to $10^{-5}$ S/cm[1]), the failure of BTATZ/graphite mixtures ($\sigma \approx 4\times10^{-7}$ S/cm) to pass electrostatic sensitivity tests is understandable.

The electrostatic sensitivity test (EST) was designed to simulate an electrostatically charged person or object discharging through a thin layer of sample to a grounded conductive surface. Sample reactivity, conductivity, and morphology (particle size and shape) all effect electrostatic sensitivity. To pass the EST, a material must not ignite ten out of ten times. Neat BTATZ ignites ten out of ten times, while BTATZ/graphite mixtures ignite within the first few attempts. While most of our mixtures failed after a few attempts, illustrated in TABLE 1, the PT-coated BTATZ passed ten out of ten tests.

TABLE 1

| CP (wt % oxidant) | σ (S/cm) | Charging in SEM | EST Passed/Attempts |
|---|---|---|---|
| PEDOT (5/$FeCl_3$) | $2 \times 10^{-3}$ | No | 2/3 |
| Pref. PEDOT (5/$FeCl_3$) | $<2 \times 10^{-7}$ | Some | 1/2 |
| PPy (10/$FeCl_3$/$CHCl_3$) | $2 \times 10^{-3}$ | Some | 5/6 |
| PT (5/$FeCl_3$) | $<2 \times 10^{-7}$ | Slowly | 10/10 |
| None | $3 \times 10^{-8}$ | Yes | 0/10 |

Another preferred embodiment is to deposit neutral, soluble electroactive polymers (such as poly(3-hexylthiophene) or any other soluble electroactive polymer, typically made soluble by incorporation of long chain alkyl- or oligomeric ether substituents) from solution, then oxidize the coating in place with oxidants such as iodine or an oxidizing solution (such as ferric chloride in a solvent that does not dissolve the polymer coating—obviously this would be polymer-dependent). The advantages of this coating, then doping method (as opposed to the doping, then coating method) are that the polymers are fully characterized prior to the coating process, that the coating on the particles is ideally more uniform, that the coating thickness is precisely controlled, and that the doping level is precisely controlled.

It should be understood that the examples and embodiments described herein are for illustrative purposes only and that various modifications or changes in light thereof will be suggested to persons skilled in the art and are to be included within the spirit and purview of this application and the scope of the appended claims.

We claim:

1. An electrostatic charge dissipation composition comprising:

at least one energetic particle component;

at least one binder in combination with said energetic particle component; and at least one neutral electrically active polymer, said polymer is oxidized after said polymer is coated on said energetic component to provide sufficient conductivity to prevent premature electrostatic discharge of said composition, wherein said oxidizing agent is selected from the group consisting of ferric salts including ferric chloride halogens, cupric salts, Lewis acids, cupric salt/Lewis acids, and gold (III).

2. The composition according to claim 1, wherein said binder is a non-electrically conducting polymer.

3. The composition according to claim 1, wherein said polymer is coated on said at least one binder in combination with said energetic particle component.

4. The composition according to claim 1, wherein said binder is selected from the group consisting of poly(lauryl methacrylate) (PLMA), hydroxyl-terminated polybutadiene (HTPB), poly(ethyl acrylate), organic elastomers, halogenated elastomers, and any combination thereof.

5. The composition according to claim 1, further comprising a non-conducting energetic binder selected from the group consisting of nitrocellulose, GAP, PGN, cellulose acetate, and any combination thereof.

6. The composition according to claim 1, wherein said polymer is sufficiently coated to form a continuous interconnecting network having multiple sets of contact points so that there are sufficient infinite paths that promote static dissipating properties.

7. The composition according to claim 1, wherein said energetic particle component is selected from the group consisting of lead azide, lead styphnate, mercury fulminate, silver azide, diazodinitrophenol, tetrazene, hexa-nitro-hexa-aza-isowurtzitane, ammonium perchlorate, ammonium dit-ramide, ammonium nitrate, cyclotrimethylenetrinitramine, cyclotetramethylene tetranitramine, bis (aminotetrazolyl) tetrazine (BTATZ), their analogs, homologs, derivatives, salts, and any combination thereof.

8. The composition according to claim 1, wherein said polymer is selected from the group consisting of PEDOT, modified PPy, their analogs, homologs, derivatives, isomers, and any combination thereof.

9. The composition according to claim 1, wherein said polymer is further selected from the group consisting of polyaniline, polyacetylene, their analogs, homologs, derivatives, isomers, and any combination thereof.

10. The composition according to claim 1, wherein said polymer is PEDOT, modified PPy, PANI, PA, which is modified to be further selected from the group consisting of conducting polymers bearing solublizing substituents including alkyls, ethers, aromatics, oligomeric ethers, their substituents for improved binder function of crosslinking groups including acrylates, methacrylates, urethanes, and crosslinkers including CTPB and PAO.

11. The composition according to claim 1, wherein said energetic component is BTATZ, its analogs, homologs, derivatives, salts, or any combination thereof.

12. The composition according to claim 1, wherein said energetic component is BTATZ, its analogs, homologs, derivatives, or any combination thereof.

13. The composition according to claim 1, wherein said energetic component is BTATZ, or its salts thereof.

14. The composition according to claim 1, wherein said polymer is PEDOT.

15. The composition according to claim 1, wherein said polymer is modified PT.

16. The composition according to claim 1, wherein said energetic particle component is about 80% to about 99.9% by weight and said polymer is about 0.1% to about 20% by weight of said composition.

17. The composition according to claim 1, wherein said energetic particle component is about 90% to about 95% by weight and said polymer is about 5% to about 10% by weight of said composition.

* * * * *